US010953298B1

(12) United States Patent
Perez Gutierrez

(10) Patent No.: US 10,953,298 B1
(45) Date of Patent: Mar. 23, 2021

(54) BASKETBALL TRAINER DEVICE

(71) Applicant: Mario Ernesto Perez Gutierrez, Bogota (CO)

(72) Inventor: Mario Ernesto Perez Gutierrez, Bogota (CO)

( * ) Notice: Subject to any disclaimer, the term of this patent is extended or adjusted under 35 U.S.C. 154(b) by 0 days.

(21) Appl. No.: 16/690,389

(22) Filed: Nov. 21, 2019

(51) Int. Cl.
*A63B 69/00* (2006.01)
*A63B 69/34* (2006.01)
*A63B 71/02* (2006.01)
*A63B 67/00* (2006.01)

(52) U.S. Cl.
CPC ..... *A63B 69/0071* (2013.01); *A63B 69/34* (2013.01); *A63B 67/002* (2013.01); *A63B 69/0026* (2013.01); *A63B 2071/025* (2013.01); *A63B 2243/0037* (2013.01)

(58) Field of Classification Search
CPC ..... A63B 69/0071; A63B 69/34; A63B 2071/025; A63B 2243/0037; A63B 69/0002; A63B 69/0075
USPC ..... 473/447, 454, 459, 449, 442, 462, 450, 473/458, 430, 439, 476–478; D21/781, D21/635
See application file for complete search history.

(56) References Cited

U.S. PATENT DOCUMENTS 928,674 A * 7/1909 Lenz ..... A63B 69/0002 473/454
3,048,395 A * 8/1962 Hobbs ..... A63B 67/007 472/128
3,391,936 A * 7/1968 Grimes ..... A63H 30/04 473/439
4,079,939 A * 3/1978 Raistakka ..... A63B 67/06 273/402
4,565,527 A * 1/1986 Burchett ..... A63B 69/0071 473/446
4,635,943 A * 1/1987 Lumpkin ..... A63B 67/06 473/588
4,934,938 A * 6/1990 Orlandi ..... G09B 19/0038 473/444
D321,370 S * 11/1991 Curtis ..... 473/447
5,160,138 A * 11/1992 Sanders ..... A63B 69/0026 473/438

(Continued)

FOREIGN PATENT DOCUMENTS

CN 203370263 U 1/2014

*Primary Examiner* — Mitra Aryanpour
(74) *Attorney, Agent, or Firm* — Hoglund & Pamias, PSC; Roberto J. Rios

(57) ABSTRACT

The present invention pertains to the field of material for physical education, gymnastics, swimming, climbing or fencing, ball games, training material and specifically to training apparatus or apparatus intended for particular sports, consisting of a basketball trainer device composed of a body in the form of a silhouette with a cavity for traversing a ball within a frame and training aim or with said cavity covered with a lining to train reception by the bounce of the ball on the lining; a conical base filled with a weight ballast to keep basketball trainer device upright; removable swivel wheels for movement; riatas of connection with the player, connection with several players or connection with another device and the player simultaneously; where the basketball trainer device has the ability to remain static or moving, rotate 360° and flex up to between zero degrees and fifty degrees measured from the vertical axis.

11 Claims, 10 Drawing Sheets

(56) References Cited

U.S. PATENT DOCUMENTS 5,413,328 A * 5/1995 Glancey ..... A63B 63/00 473/439
5,855,372 A * 1/1999 Thiemann ..... A63B 67/002 273/349
6,220,976 B1 * 4/2001 Kaiser ..... A63B 63/008 473/439
6,736,738 B1 * 5/2004 Taa ..... A63B 63/008 473/439
6,866,595 B1 * 3/2005 Elder ..... A63B 69/002 473/446
7,288,033 B1 * 10/2007 Jordan ..... A63B 63/00 473/439
7,736,247 B2 * 6/2010 Caruso ..... A63B 69/002 473/422
8,152,660 B1 * 4/2012 Jimenez, Jr. ..... A63B 69/0071 473/422
8,277,340 B1 10/2012 Devine
8,721,476 B2 5/2014 Mayers
8,900,076 B1 * 12/2014 Shropshire ..... A63B 69/002 473/439
D730,460 S * 5/2015 Zampese ..... D21/699
9,931,555 B1 * 4/2018 McCoy ..... A63B 69/0071 473/422
10,207,167 B2 * 2/2019 Downing ..... A63B 69/0075 473/459
10,307,655 B1 * 6/2019 Dorsey ..... A63B 69/345 473/438
10,500,465 B1 * 12/2019 Panaia ..... A63B 69/0071 473/422
2003/0211906 A1 * 11/2003 Seltzer ..... A63B 69/0071 473/450
2005/0192126 A1 * 9/2005 Remaklus ..... A63B 63/083 473/447
2005/0272534 A1 * 12/2005 Bayduke ..... A63B 69/345 473/438
2009/0149281 A1 6/2009 Johnson

* cited by examiner

BASKETBALL TRAINER DEVICE

FIELD OF THE INVENTION

The present invention pertains to the field of material for physical education, gymnastics, swimming, climbing or fencing, ball games, training material and specifically to training apparatus or apparatus intended for particular sports, consisting of a basketball trainer device composed of a body in the form of a silhouette with a cavity for traversing a ball within a frame and training aim or with said cavity covered with a lining to train reception by the bounce of the ball on the lining; a conical base filled with a weight ballast to keep basketball trainer device upright; removable swivel wheels for movement; riatas of connection with the player, connection with several players or connection with another device and the player simultaneously; where the basketball trainer device has the ability to remain static or moving, rotate 360° and flex up to between zero degrees and fifty degrees measured from the vertical axis.

BACKGROUND OF THE INVENTION

In the state of the art is known the U.S. Pat. No. 7,198,580 B2 filed on Jun. 21, 2005, which describes an obstacle device for use on a playing field has a base and a frame approximating in shape the front profile of a human head and torso. The frame is coupled to the base. The frame includes a collapsible frame member that has an expanded configuration that defines an expanded frame area. The frame member also has a collapsed configuration that defines a collapsed frame area that is less than the expanded frame area. A covering material is attached to the frame so that the covering material is spread by the frame when the frame member is in the expanded configuration. The new invention does not have a stake as a base for its stability with the ground, on the contrary, its base is cone-shaped and can be filled inside with sand, water or other heavy ballast that gives it: stability, to stand firm vertically and balanced movement, to resist personal contact without falling to the ground.

There is also U.S. Pat. No. 8,277,340 B2 filed on May 18, 2010, which provides a basketball training device that mimics an opposing player during practice. The training device has a weighted base set on caster wheels. A vertical support extends upwardly from the base. A slide structure moves up and down on the vertical support between a high position and a low position. A blocking form is coupled to the slide structure. The blocking form moves with the slide structure. Consequently, the blocking form can move up and down. An elongated control rod attaches to the wheeled base. The control rod is used by a coach to push and pull the training device along the basketball court during play. In this manner, a coach can adjust the position of the blocking form to better mimic the movements of a real opposing player. The new invention also has wheels on its base that allow it to move to different areas, with the difference that these wheels can be stored in the base and thus make the basketball trainer device static in one place, without moving when Make contact with the player. The basketball coach device also has a hollow space in your body that allows you to perform pass exercises and aiming in training.

It is also known U.S. Publication Application No. US20090149281A1 published on Jun. 11, 2009, which describes a basketball or soccer training device has a base, a body having a lower body portion and an upper body portion with the lower body portion overlying the base. The upper body portion has a first pair of arms projecting generally outwardly in generally-opposite directions and a second pair of arms projecting generally upwardly in relative spaced relationship. The lower body portion may have a pair of legs terminating in weighted feet. The base may be hollow and be dimensioned and structured to receive an inflatable, basketball training device when in deflated condition. A corresponding method is provided. The new invention is made of plastic material, which gives it rigidity and resistance to contact. Likewise, at its base it has wheels that allow it to move around the area. This movement is achieved with a riata that connects to the body of the basketball coach device with the person who is using it, in this way exercises are carried out in which it involves the accompaniment of the basketball coach device in the movement of the player.

It is in the state of the art Publication Application No. CN203370263 U published Jan. 1, 2014, which describes a human body model used for basketball confrontation training comprises a suction cup base, a lower supporting rod, a fastening screw, an upper supporting rod and a human body model body and is characterized in that the lower supporting rod is fixedly arranged right on the top of the suction cup base, the upper supporting rod is fixedly arranged right at the bottom of the human body model body, the lower supporting rod is in a tubular shape, the upper supporting rod is inserted into the lower supporting rod in a matched mode and fastened through the fastening screw arranged on the portion, on the upper middle portion of the lower supporting rod, of the outer surface of the lower supporting rod, and the upper supporting rod is elastic. In practical application, one or more human body models used for basketball confrontation training can be fixed to proper positions of a basketball court through the suction cup base, and therefore the model can simulate a simulated enemy so that a sportsman can conduct training such as breaking through and shooting, the height of a telescopic rod can be adjusted so that the model can stimulate rivals at different heights and confrontation training can be conducted, and the training effect can be improved. The new invention has an internal chamber inside the base, which can be filled with heavy material so that the basketball trainer device can be tilted without falling. Likewise, the body of the device is rotational, that is, it rotates 360° on the axis that is the support bar that is connected to the base.

U.S. Pat. No. 8,721,476 B2 filed Aug. 16, 2012, which describes a basketball training device which resembles a mannequin that defends against basketball players with a series of blocking motions. When a proximity sensor detects an approaching player, a control unit initiates waving of forearms, raising/lowering of upper arms, chopping motion of arms and torso raising and lowering. An audio circuit plays music or realistic background noises. When convex bottom of primary base is placed on a floor, weight of ballast and rechargeable batteries allows the device to return to an upright position when tipped. A gyroscopic unit within a control unit can activate when the device tips to ensure return of the device to an upright position. Alternatively, the unit can be placed with the secondary base, which features castors that allow the unit to roll when stuck and facilitates placement on a basketball court. The new invention has a hollow space in the body of the basketball trainer device, which can be covered with a lining according to the function you want to perform in training. Without the lining, pass precision exercises can be performed, and with the lining, exercises can be performed where the bounce of the ball to the player is required. In addition, the new invention has a distance rod that connects the player with the basketball trainer device and thus be able to perform pressure and accompaniment exercises. With respect to the mobility of the arms, the new invention has a graduation mechanism that contains a toothed guide that adjusts to the teeth that each end of the arms contains, allowing to adjust the position of the arms according to the need for exercise, while the antecedent has a rotation joint for the arms, which allows the arm to rotate around its longitudinal axis.

BRIEF DESCRIPTION OF THE DRAWINGS

The attached figures illustrate the scope proposed within the following proposal of the basketball coach device.

DETAILED DESCRIPTION OF THE INVENTION

Figure 1:
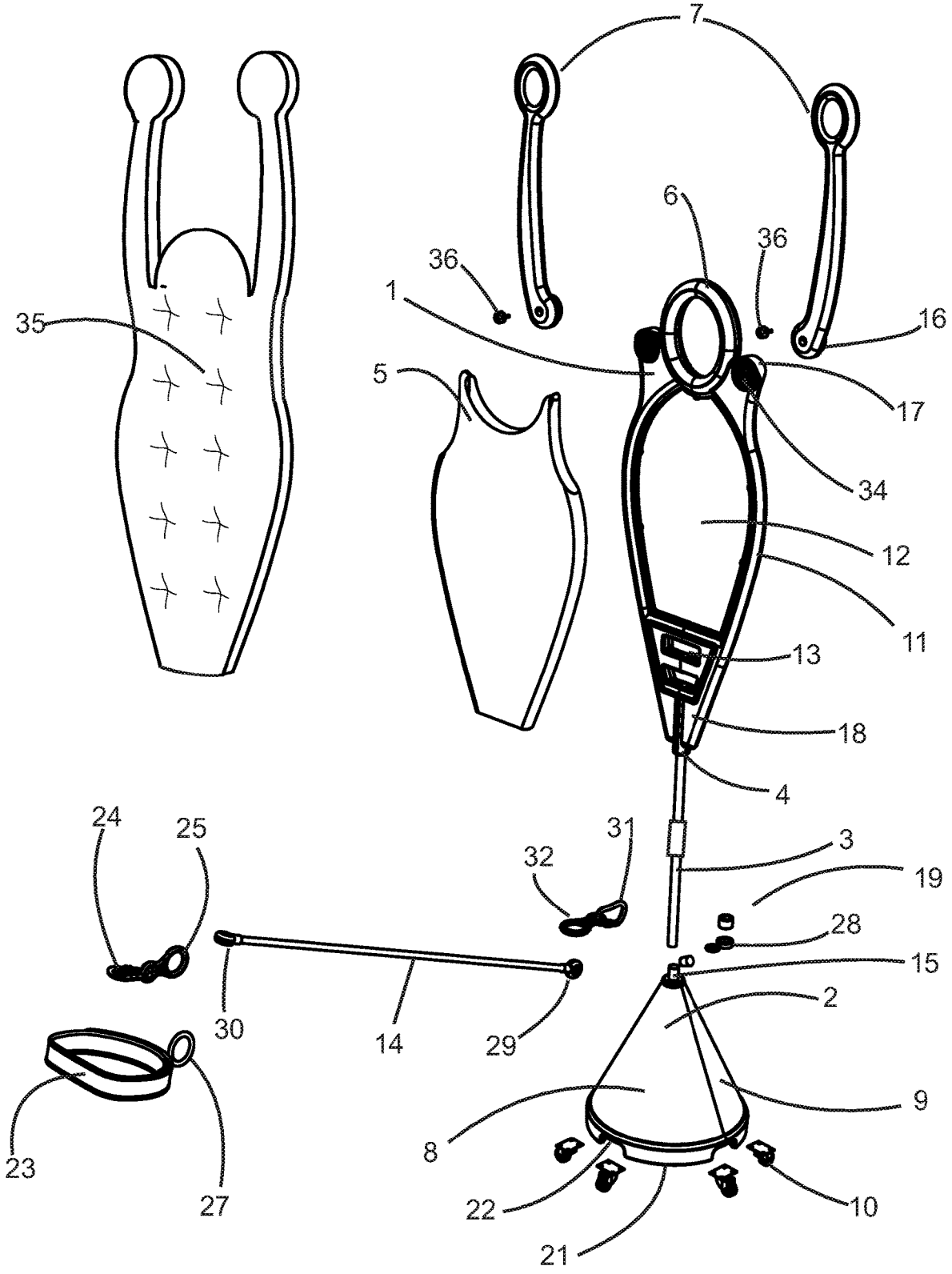
FIG. 1 presents a perspective view of an exemplary embodiment of a basketball coach device with all its components.
Figure 2:
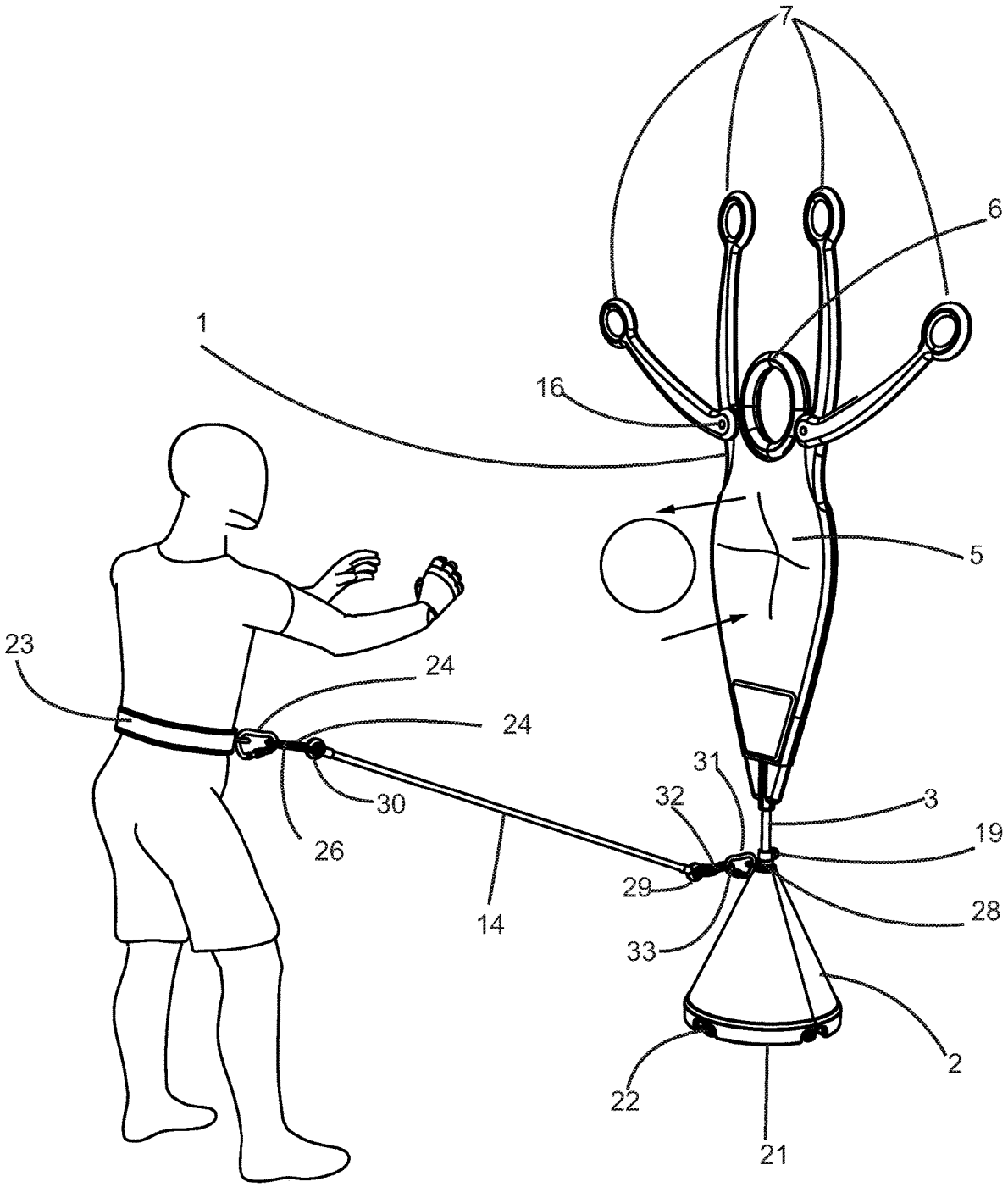
FIG. 2 presents the way the user uses the basketball trainer device with a liner to return the ball and shows how the user connects with the device.
Figure 3:
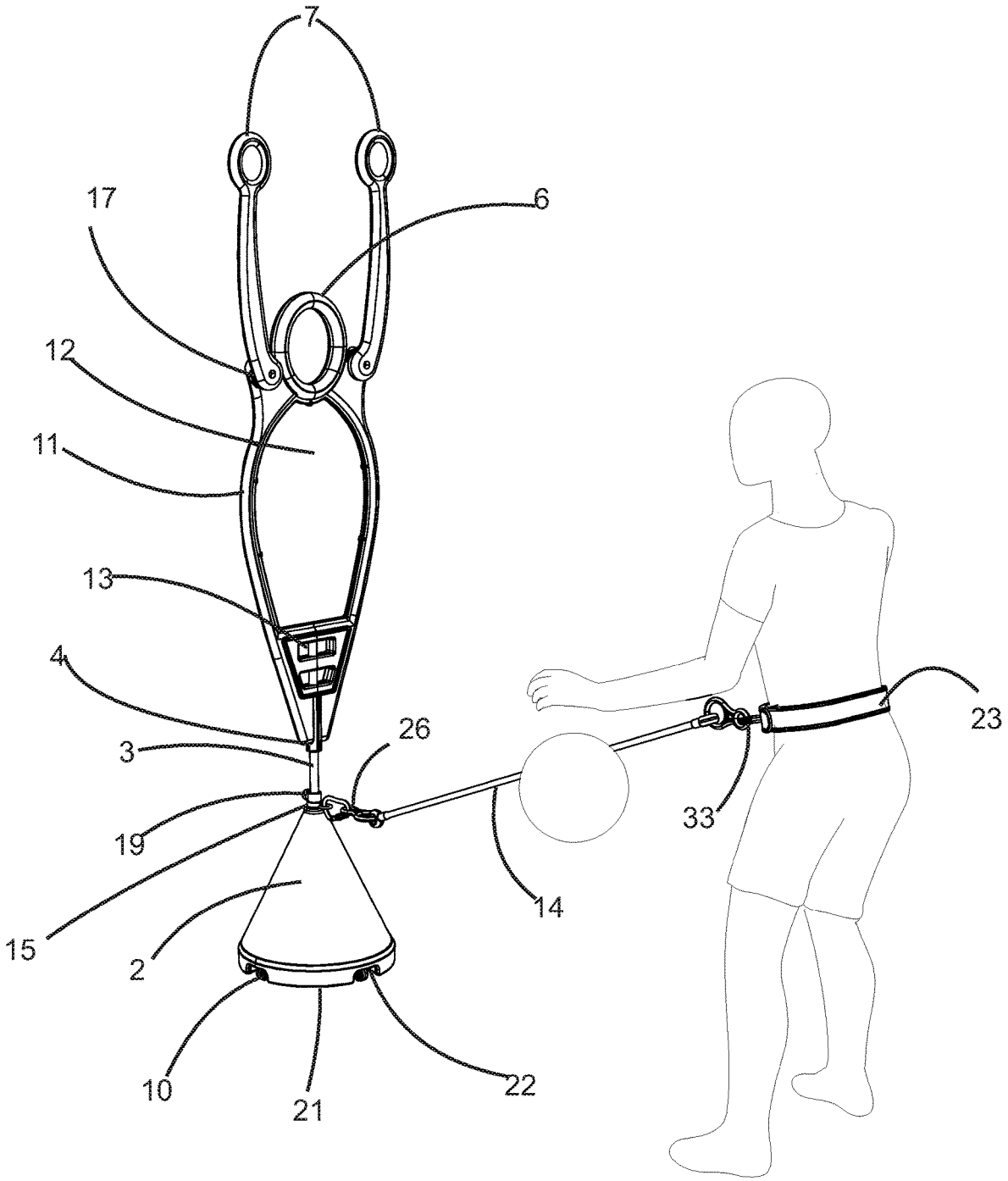
FIG. 3 presents the way the user uses the unlined basketball trainer device, with empty space or pass through, to pass the ball through the device.
Figure 4:
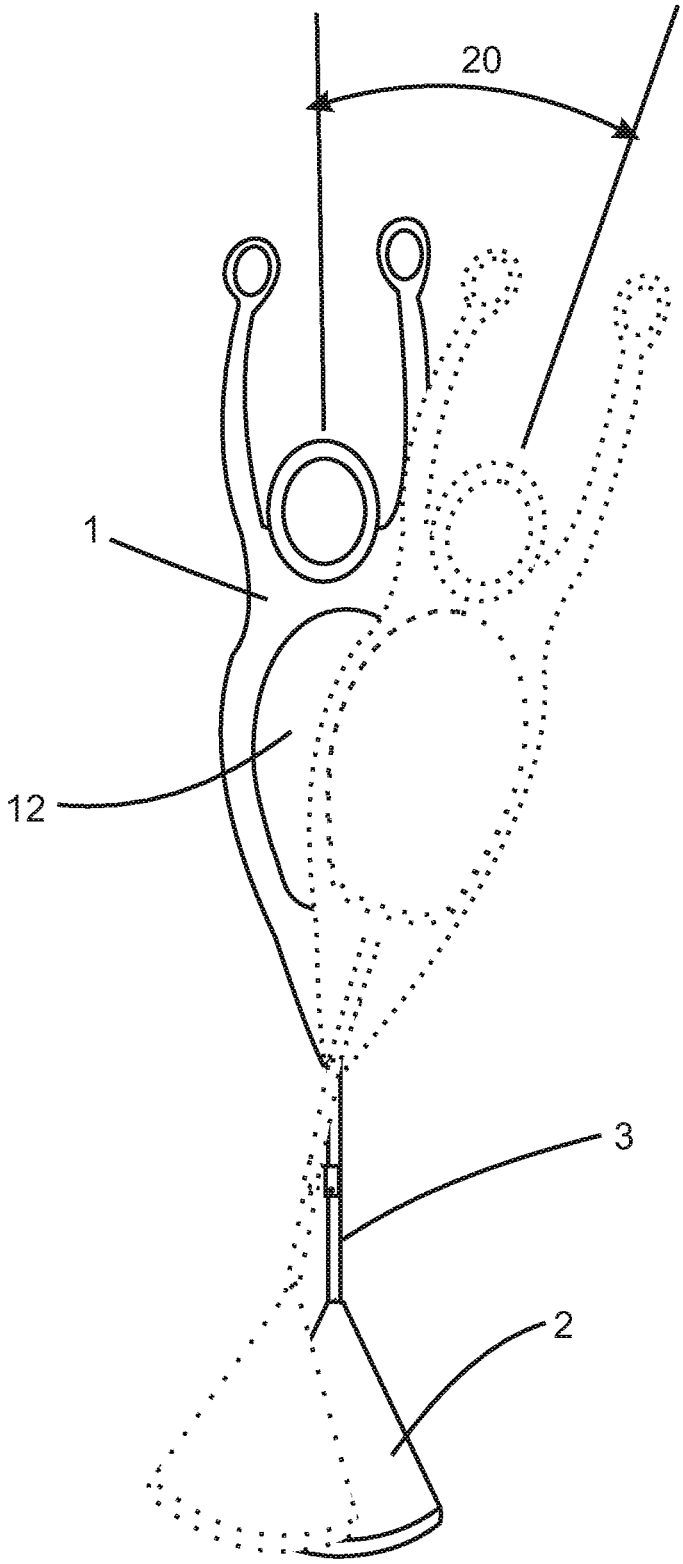
FIG. 4 shows the flexibility angle of the basketball coach device with respect to its central axis and its ability to return to its initial position due to its weight in its center of gravity.
Figure 5:
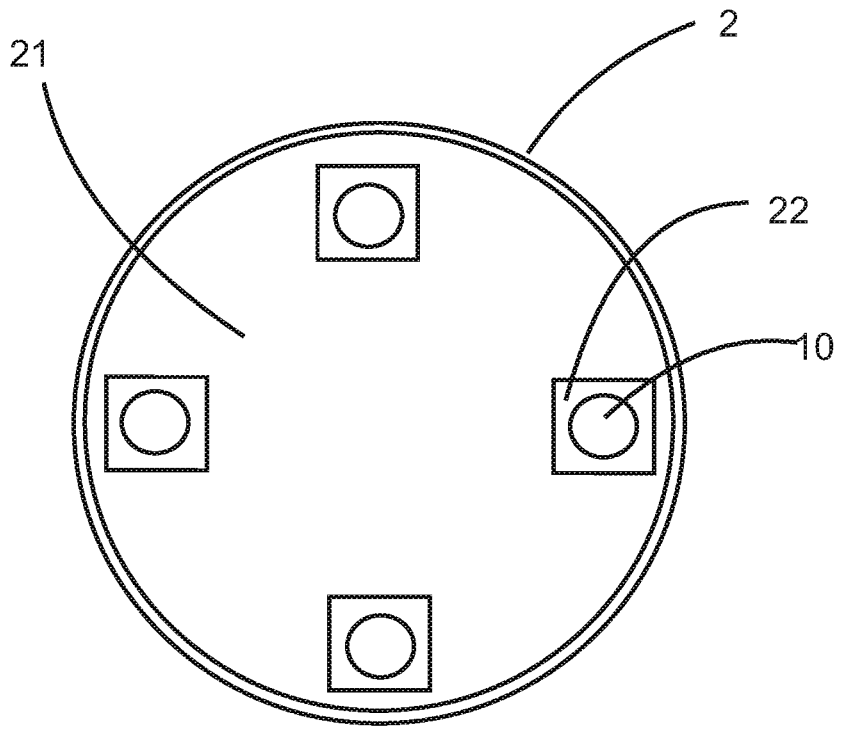
FIG. 5 shows the bottom view of the basketball trainer device with the support surface of the conical base and its removable rotating wheels.
Figure 6:
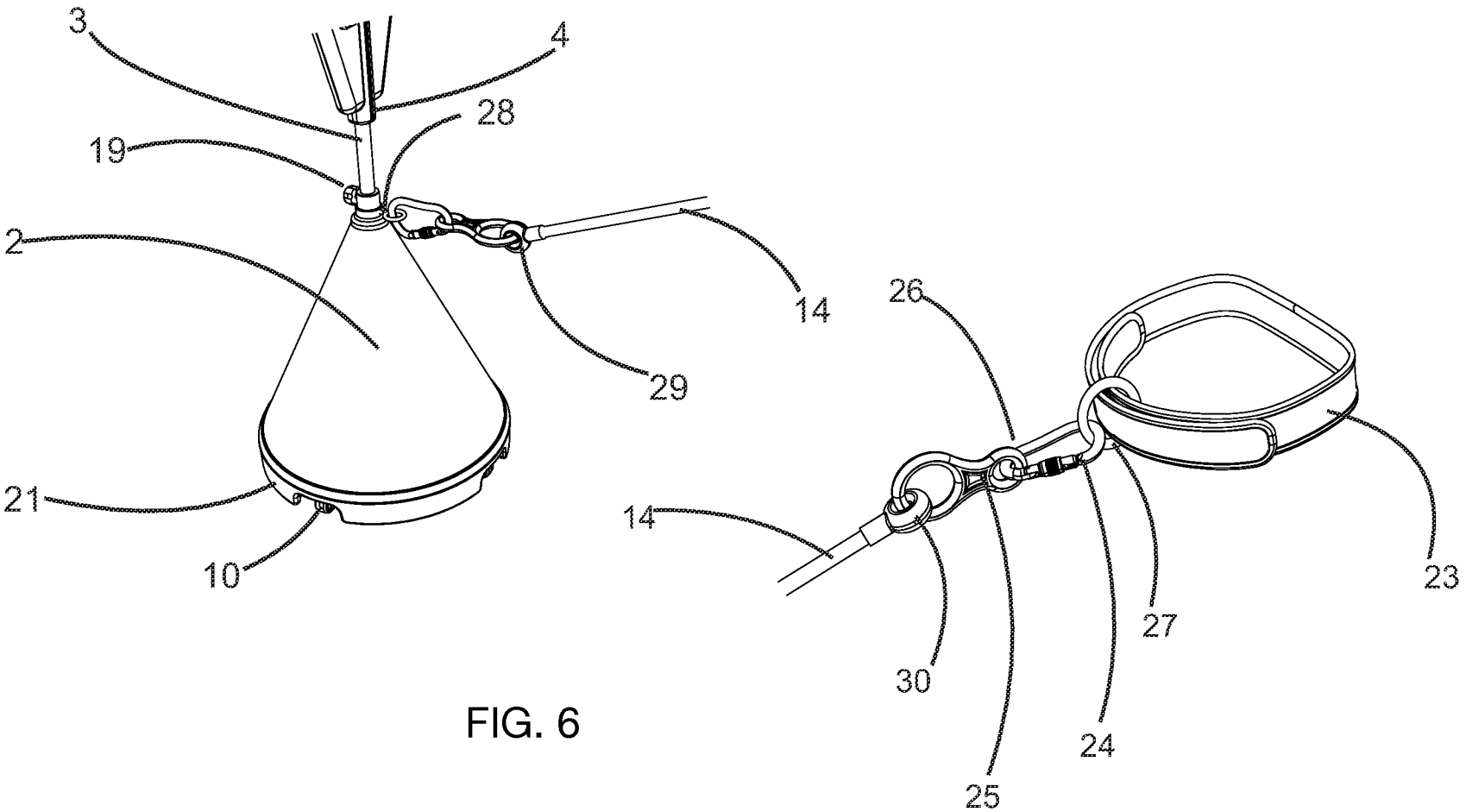
FIG. 6 shows the connecting elements of the distance rod with the basketball trainer device.
Figure 7:
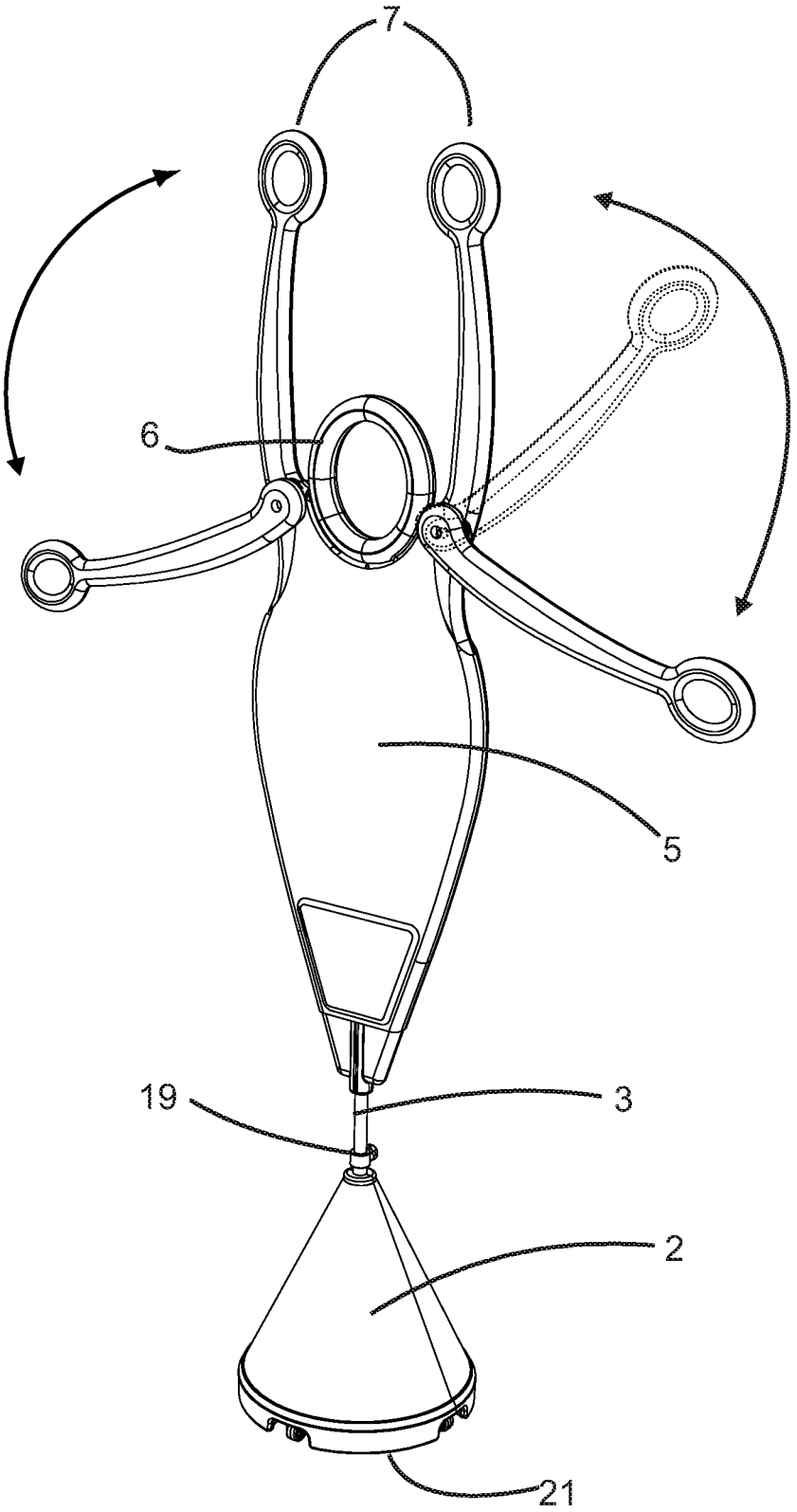
FIG. 7 shows the mobility of the arms in the basketball coach device.
Figure 8:
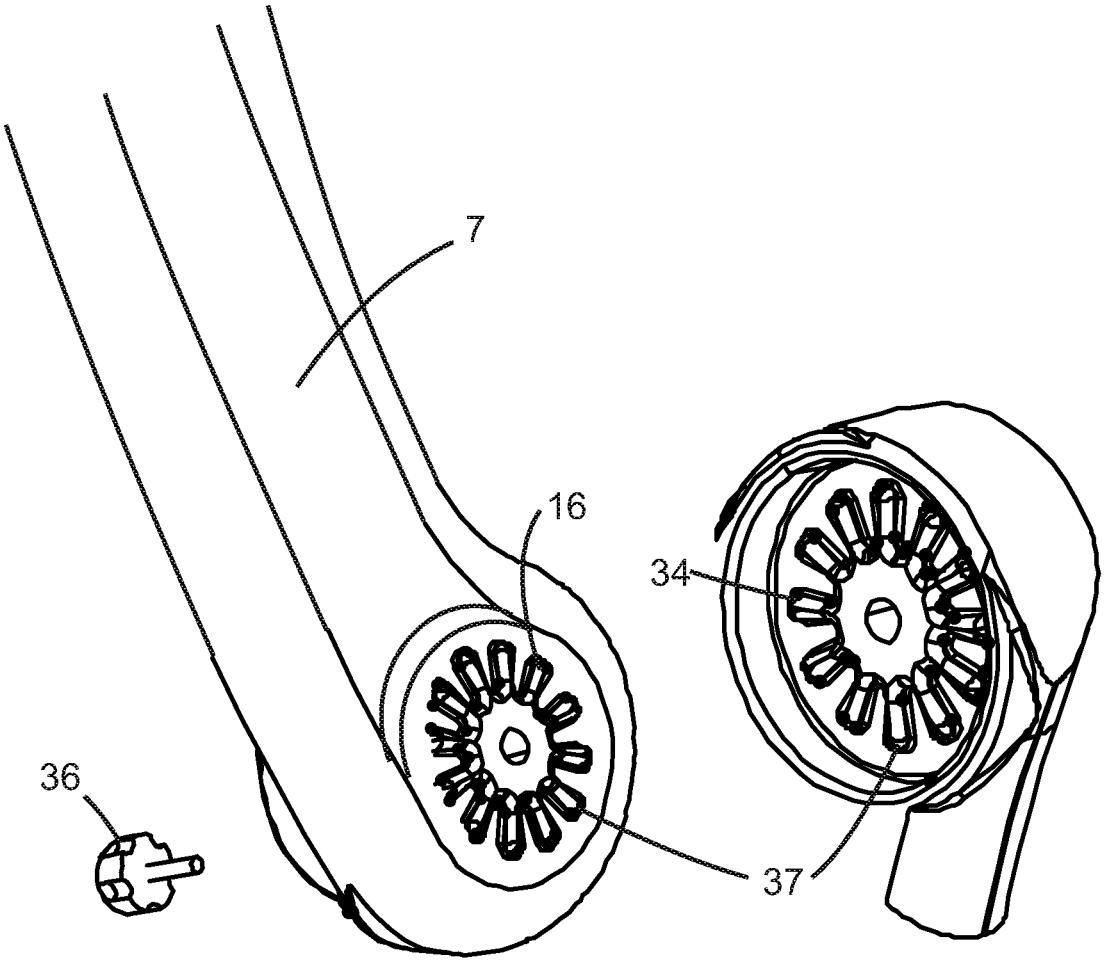
FIG. 8 shows in detail the graduation mechanism formed by assembly teeth that fit a circular toothed guide for movement and fixation of the arms in the basketball trainer device.
Figure 9:
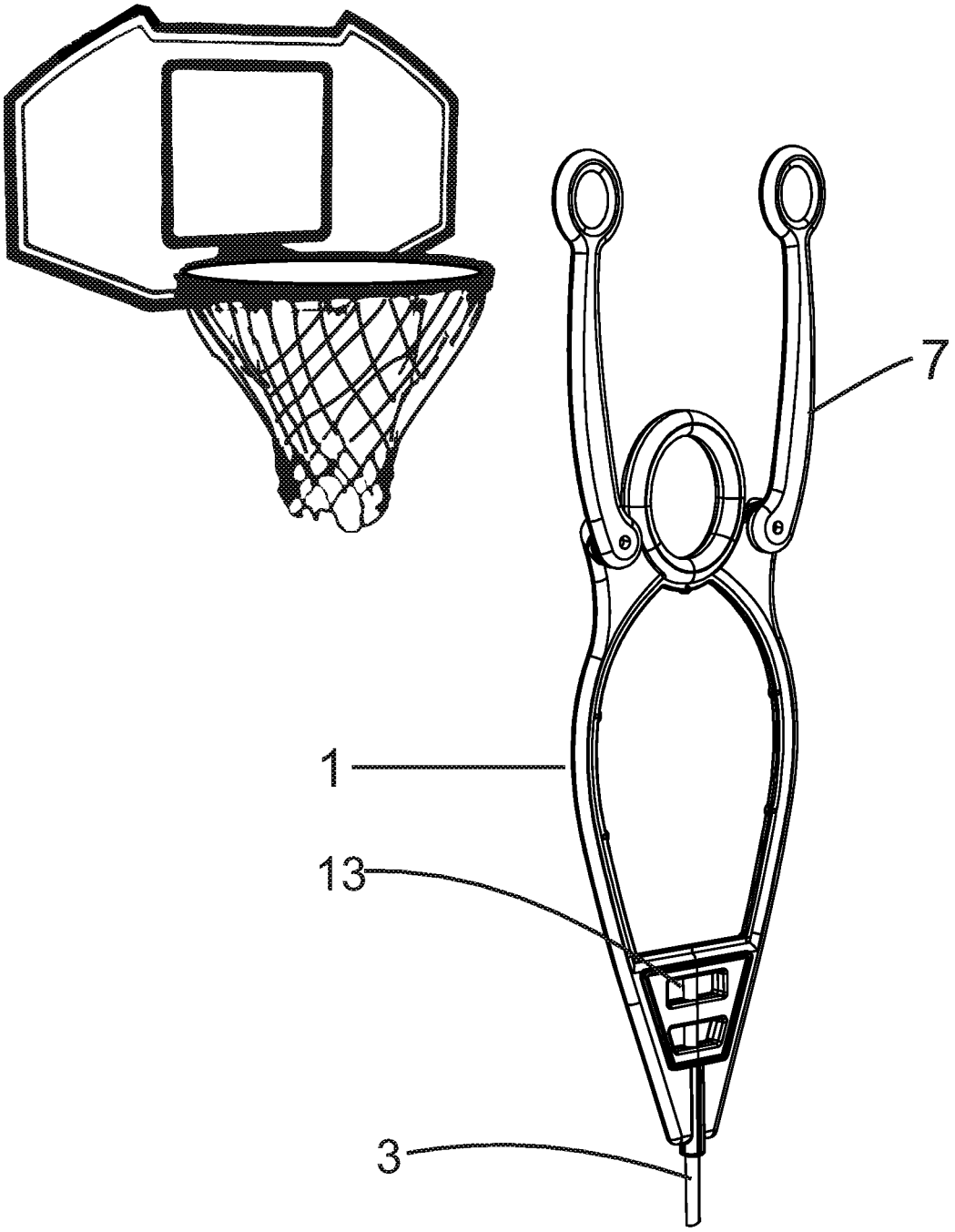
FIG. 9 shows the use of the body in the form of a silhouette (1) without inserting it into the conical base to be loaded by a person and thus perform blocking exercises to a player when throwing a basketball hoop.
Figure 10:
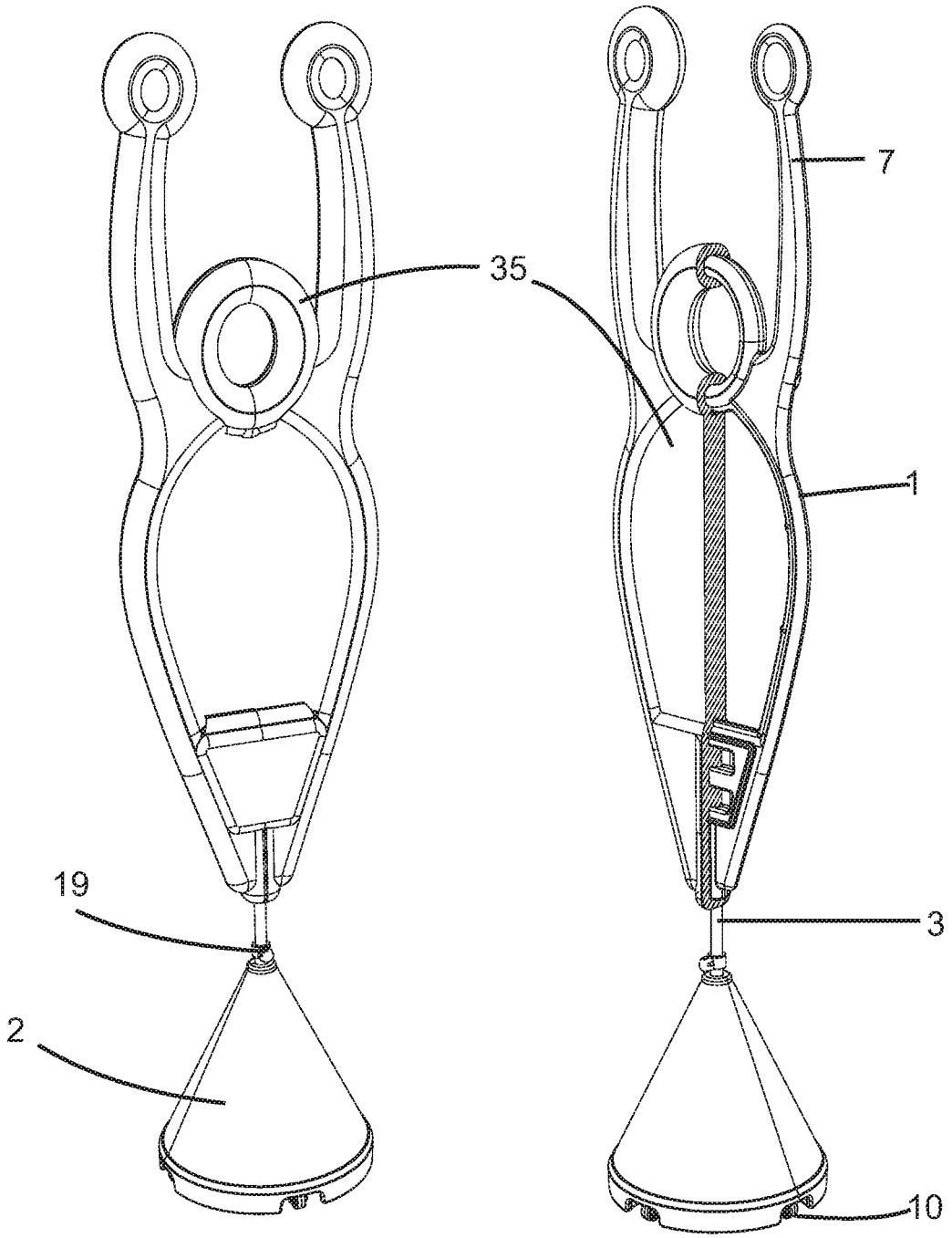
FIG. 10 shows the covering that the body has in the form of a silhouette to protect the trained basketball device.

According to the figures detailed above, the basketball coach device simulates an obstacle of an opposing player who chases the player and has the ability to remain static or moving, turn and flex. This basketball coach device is composed of an empty space or pass through (12) to pass a ball inside a frame (11) in a body in the form of a silhouette (1) and train aiming; a liner (5) for training reception by bouncing the ball on the liner (5); a support bar (3) that joins the lower part of the body in the form of a silhouette (1) with a conical base (2) of support; a conical base (2) with removable rotating wheels (10) filled with a heavy ballast (9) to keep the basketball trainer device upright and connecting strips with the player, connection with several players or connection with another device and with the player simultaneously.

The body in the form of a silhouette (1) is in the form of a player's torso with the respective arms (7) and a hoop-shaped head (6). The arms (7) retain a separation that allows the player to pass the basketball through them.

The arms (7) have a graduation mechanism (17) formed by assembly teeth (16) that fit a circular toothed guide (34) that gives them movement and fixation desired to the arms (7). Said adjustment allows the graduation of each arm (7) according to the adjustment of each assembly tooth (16) on each space of the circular toothed guide (34), which when graduated is fixed with a screw (36) so that the arm (7) is fixed in the desired position and the player performs the exercise he wishes to perform, that is, if he wishes to keep each arm (7) sideways, tilted or up.

Two arms (7) can be used for each graduation mechanism (17) increasing the difficulty of training, adjusting the arms (7) in different positions.

In the center of the body in the form of a silhouette (1) there is an empty space or pass through (12) within a frame (11), where said empty space or pass through (12) can be covered by a liner (5) according to the use that you want to give the basketball coach device. For example, if the empty space or pass through (12) is left exposed, that is, without the liner (5), exercises can be carried out where it is required to train the precision or aim of the passage of the ball through the frame (11) and if on the contrary, the empty space or pass through (12) is covered with the liner (5), exercises can be performed where the bouncing of the ball in the body in the form of a silhouette (1) is required.

The body in the form of a silhouette (1) has a lower part (18) with two windows (13). The support bar (3) joins the lower part of the body in the form of a silhouette (1) with the conical base (2), where the support bar (3) crosses a concentric hole (4) inside the lower part (18) of the body in the form of a silhouette (1) and through a receiving hole (15) in conical base (2).

In the lower section of the support bar (3) there is a double ring connector (28) that joins by means of an upper connection chain (33) with an upper bearing (29) that has the distance rod (14) at one of its extremes. The upper connection chain (33) is formed by an upper carabiner (31) and an upper 8-shaped joint (32) that allow the connection between the support bar (3) and the distance rod (14).

At the opposite end of the distance rod (14) has a lower bearing (30) that through a lower connection chain (26), formed by a lower 8-shaped joint (25), a lower carabiner (24) and a ring (27) are connected to a belt (23) worn by the player, thus allowing displacement with the rotating wheels (10) of the basketball trainer device as the player moves, simulating the accompaniment and pressure of a defensive player in training.

The conical base (2) has removable rotating wheels (10) that are stored and removed according to the need for training, and these rotating wheels (10) allow the basketball trainer device to freely roll in any direction in which it is pushed or pulled. The conical base (2) has a smooth support surface (21) with cavities (22) housing the rotating wheels (10) for storage.

When the rotating wheels (10) are stored in each cavity (22), the smooth support surface (21) of the conical base (2) rests on the floor surface so that the basketball trainer device remains in one place; when the rotating wheels (10) are removed from each cavity (22) they are the support of the basketball trainer device and allow its movement.

The support bar (3) is inserted into the conical base (2) by means of a receiving hole (15) at an adjustable height with the adjusting screw (19) according to the need of training and the player. Since the body in the form of a silhouette (1) is fixed to the conical base (2), it will be understood that the body in the form of a silhouette (1) will rise and fall as the adjusting screw (19) graduates.

In another mode of use, the support bar (3), connected with the body in the form of a silhouette (1), is not inserted into the conical base (2) to be held by a person and thus perform launch block exercises to a basketball hoop.

The body in the form of a silhouette (1) has a cover (35) that protects the device against the blows and contacts of the player when performing the exercises, taking into account that the body in the form of a silhouette (1) can rotate three hundred and sixty degrees in the horizontal plane around the support bar (3) that acts as an axis and that makes the basketball trainer device dynamic and mobile when it makes contact with the player.

The conical base (2) has an internal chamber (8) inside that can be filled with sand, water or other heavy ballast (9) to give stability to the basketball trainer device. The wide smooth support surface (21) of the conical base (2) and the center of gravity allow the training device to be tilted at an angle (20) between zero degrees and fifty degrees without falling; so that the basketball coach device retains its stability with respect to its central axis and has the ability to return to its initial vertical position due to its weight in its center of gravity.

The external design presented in the figures does not constitute a limitation for the design of other alternatives of the basketball coach device as long as it does not depart from the objective with the characteristics described herein.

The invention claimed is:

1. A basketball training device that simulates an opposing player chasing a player and has the ability to remain static, move, rotate and tilt, the device comprising:

a pass-through (12) configured within a frame (11) of a body configured to allow crossing of a ball therethrough, wherein the frame (11) has a form of a torso silhouette (1);

a liner (5) selectively configured to cover said pass-through (12) for pass-training, by bouncing a ball over the liner covering said pass-through (12);

a support bar (3) having an upper end joined to a lower part (18) of said body in the form of a torso silhouette (1) and a lower end joined to a conical support base (2);

said conical support base (2) having removable rotating wheels (10) and being filled with a heavy ballast (9) to keep the basketball trainer device in an upright position; and a distance rod (14) configured to connect said basketball trainer device to a belt worn by a player.

2. The basketball trainer device according to claim 1, further comprising a hoop-shaped head (6) provided on said body in the form of a torso silhouette (1) and arms (7) provided on the sides of said hoop-shaped head (6), wherein a graduation mechanism (17) with a circular toothed guide (34) articulated with assembly teeth (16) are provided on said arms (7).

3. The basketball trainer device according to claim 1, wherein said upper end of the support bar (3) is inserted through a concentric hole (4) inside the lower part (18) of the body in the form of a torso silhouette (1) and said lower end of the support bar (3) is inserted through a receiving hole (15) in said conical support base (2).

4. The basketball trainer device according to claim 1, further comprising a double ring connector (28) connected to said conical support base (2) and to an upper carabiner (31) which is also connected to an upper 8-shaped joint (32) that is also connected to an upper bearing (29) of the distance rod (14).

5. The basketball trainer device according to claim 1, wherein said distance rod (14) has a lower bearing (30) connected to a lower 8-shaped joint (25) which is also connected to a lower carabiner (24) which in turn is connected to a ring (27) that is coupled to said belt (23) configured to be worn by a player.

6. The basketball trainer device according to claim 1, wherein the conical support base (2) has a smooth support surface (21) with cavities (22) housing the removable rotating wheels (10).

7. The basketball trainer device according to claim 1, wherein the support bar (3) is inserted into a receiving hole (15) provided on said conical support base (2) and an adjusting screw (19) is provided to adjust a height of said support bar (3).

8. The basketball trainer device according to claim 1, wherein the support bar (3) is oriented along a vertical axis of the body in the form of a torso silhouette (1) and said body in the form of a torso silhouette (1) is configured to rotate three hundred and sixty degrees in relation to the support bar (3).

9. The basketball trainer device according to claim 1, wherein the body in the form of a torso silhouette (1) has a cover (35) that protects the device from shocks.

10. The basketball coach device according to claim 1, wherein the conical support base (2) has an internal chamber (8) filled with said heavy ballast (9) to provide stability to the device and to allow the device to tilt at an angle between zero degrees and fifty degrees with the ability to return to an initial vertical position due to a weight in a center of gravity of said device.

11. The basketball trainer device according to claim 1, wherein the support bar (3) is inserted in the body in the form of a silhouette (1) and is detachable from the conical support base (2) so that the body in the form of a torso silhouette (1) is lifted and manipulated by a person.

* * * * *